United States Patent [19]

Nicholas

[11] Patent Number: 4,916,878

[45] **Date of Patent: * Apr. 17, 1990**

[54] COMPRESSION SEAL WITH INTEGRAL SURFACE COVER PLATE

[75] Inventor: John D. Nicholas, Lawrenceville, Ga.

[73] Assignee: MM Systems Corporation, Tucker, Ga.

[ * ] Notice: The portion of the term of this patent subsequent to Mar. 28, 2006 has been disclaimed.

[21] Appl. No.: 329,249

[22] Filed: Mar. 27, 1989

Related U.S. Application Data

[63] Continuation-in-part of Ser. No. 12,688, Feb. 9, 1987, Pat. No. 4,815,247.

[51] Int. Cl.[4] ..... E04B 1/68; E01C 11/10; E04F 15/14

[52] U.S. Cl. ..... 52/396; 404/47; 404/64

[58] Field of Search ..... 52/403, 393, 396; 404/64, 47, 65–69

[56] References Cited

U.S. PATENT DOCUMENTS

| | | | |
|---|---|---|---|
| 2,230,688 | 2/1941 | Irwin | 404/65 |
| 3,119,204 | 1/1964 | Williams | 52/396 |
| 3,606,826 | 9/1971 | Bowman | 404/64 |
| 3,765,784 | 10/1973 | Watson et al. | 404/65 |
| 4,815,247 | 3/1989 | Nicholas | 52/396 |

FOREIGN PATENT DOCUMENTS

| | | | |
|---|---|---|---|
| 286295 | 9/1966 | Australia | 404/64 |
| 1336243 | 7/1962 | France | 52/403 |
| 1409864 | 7/1965 | France | 404/69 |
| 2250003 | 5/1975 | France | 52/396 |
| 956706 | 4/1964 | United Kingdom | 404/65 |

*Primary Examiner*—James L. Ridgill, Jr.
*Attorney, Agent, or Firm*—Jones, Askew & Lunsford

[57] ABSTRACT

An apparatus for sealing expansion joints between concrete slabs and the like comprises a compression seal member, which fits within the expansion joint and provides an airtight and watertight seal; and a surface cover plate, which provides a planar pedestrian treadway, supports vertical loads, prevents dirt and debris from entering and accumulating within the expansion joint, and provides an aesthetically pleasing appearance.

10 Claims, 3 Drawing Sheets

COMPRESSION SEAL WITH INTEGRAL SURFACE COVER PLATE

CROSS REFERENCE TO RELATED APPLICATION

This application is a continuation-in-part of application Ser. No. 012,688, filed Feb. 9, 1987, now U.S. Pat. No. 4,815,247 issued Mar. 28, 1989.

TECHNICAL FIELD

The present invention relates generally to devices for sealing voids between adjacent dynamic structural members, and relates more specifically to an elastomeric compression seal for sealing a thermal expansion tolerance space between concrete slabs and the like and having an integral surface cover plate for covering the exposed seal surface.

BACKGROUND OF THE INVENTION

Compression seals for sealing expansion joints, or movement tolerance spaces, between adjacent dynamic members such as concrete slabs in bridges, parking decks and the like are well-known. Typically, such a compression seal is formed as an elastomeric extrusion of indeterminate length and having a cross-sectional configuration designed to collapse in a controlled manner to accommodate thermal expansion and contraction of the adjacent structural members. When the seal is installed in the movement tolerance space between adjacent concrete slabs, the seal is compressed as the slabs thermally expand; and as the slabs thermally contract, the resilient seal expands to maintain constant contact with the opposing vertical walls of the adjacent structural members, thereby providing a weatherproof seal of the expansion joint.

There are a number of problems associated with such prior art compression seals. When used for pedestrian traffic applications, the compression seal must expand and collapse while maintaining a substantially planar upper surface. If the upper surface of the seal bows upwardly as the seal is compressed, the seal will protrude above the adjacent structural members such that pedestrians can trip over it, or such that it can become dislodged by snow plows and the like. Conversely, if the upper surface of the seal collapses downwardly as the seal is compressed, women's high heels can easily become lodged in the depression. Further, dirt and debris can accumulate in such depressions, accelerating wear on the seal or impairing movement of the joint.

In addition, in many applications the seal must not only maintain a watertight seal but must also be capable of supporting a vertical load, which typically requires more or thicker seal walls, increasing the cost of the seal. If a direct loading of the seal exceeds the seal's resistance to vertical forces, the seal can become dislodged from the joint walls, causing a loss of watertight integrity. Finally, use of the seal in sunlit areas exposes the seal to ultraviolet radiation, which accelerates aging of the elastomer. Since the seal is dependent upon its elasticity in order to maintain an effective seal between the adjacent structural members, such accelerated aging of the elastomer can result in premature seal failure.

An alternative approach to covering the movement tolerance space between adjacent dynamic members is the surface cover plate. The cover plate is coplanar with the upper surfaces of the adjacent members and is fixed to one of the adjacent members and movable with respect to the other. As the members expand and contract, the free end of the cover plate slides relative to the adjacent slab. The flat upper surface of the cover plate is well-suited to pedestrian traffic. The cover plate is better suited to accommodating vertical forces than a compression seal, since the plate bears downwardly against the horizontal upper surfaces of the adjacent members, rather than being dependent upon frictional contact with vertical surfaces to support a vertical load. And, the cover plate provides a more aesthetically pleasing appearance than a compression seal. However, the cover plate is neither watertight nor airtight and is thus poorly suited to applications where providing a barrier against the elements is necessary.

Accordingly, there is a need to provide an apparatus for sealing the movement tolerance joint between adjacent structural members which is conducive to pedestrian traffic, and yet provides an airtight and watertight seal.

Efforts have been made to combine a compression seal and a cover plate into an integrated unit. One such example is found in French Pat. No. 2,250,003, which discloses a compression seal of circular cross-section and a joint cover connected to the upper central portion of the circular compression seal by a stem. When the compression seal is installed within the movement tolerance space between adjacent structures, one edge of the joint cover is glued to an adjacent structure, the other edge of the joint cover moving with respect to the opposite structure as the joint opens and closes. However, this device suffers from the disadvantage that the circular seal distorts upwardly as the joint is compressed, which upward distortion tends to displace the connecting stem upwardly, forcing the joint cover upwardly. Over time, and with exposure to moisture and temperature extremes, the adhesive bond between the joint cover and the adjacent structure may weaken, permitting the joint cover to be lifted off the joint as the seal is compressed, with the result that the integrity of the joint is compromised.

One effort to overcome this problem is shown in British Pat. No. 956,706, which discloses another design of a compression seal with attached joint cover. The compression seal has a generally V-shaped sectional configuration, and the joint cover is attached to the seal at the vertex of the "V". In this manner, as the joint closes, compressing and distorting the seal, the vertex is displaced downwardly. The stem is thereby placed under tension, pulling the joint cover firmly downward against the upper surface of the adjacent structures. While this design appears to solve the problem of the joint cover lifting away from the adjacent structures as the seal is compressed, a new problem is presented. As the joint opens and the seal expands, the vertex of the "V" is now displaced upwardly, thereby applying an upward force to the stem, again lifting the joint cover away from the surface of the adjacent structures. Thus, rather than the joint cover being displaced as the seal is compressed, the joint cover is now displaced as the seal expands.

Thus, there is a need to provide a combination compression seal and cover plate wherein the cover plate is not dependent upon an adhesive bond to maintain firm contact with the upper surfaces of the adjacent structures.

There is a further need to provide a combination compression seal and cover plate wherein the cover plate is not displaced upwardly off the upper surfaces of the adjacent structures as the joint opens or closes.

SUMMARY OF THE INVENTION

As will be seen, the present invention overcomes these and other disadvantages associated with prior art sealing devices. Stated generally, the present invention comprises a sealing device having a compressible seal section which fits within the movement tolerance space between adjacent dynamic structures to provide an airtight and watertight seal. The sealing device is further characterized by a planar upper surface which is well suited to pedestrian traffic, provides improved support of vertical loads, and presents an aesthetically pleasing appearance.

Stated in somewhat greater detail, the sealing device of the present invention comprises an elastomeric compression seal which fits within the movement tolerance space between adjacent dynamic structures. The installed seal resiles outwardly to maintain intimate contact with mutually opposing vertical walls of the adjacent structural members, thereby providing a weather-resistant seal. The sealing device further comprises a substantially rigid cover plate operatively associated with the compression seal and lying substantially in the plane defined by the upper surfaces of the adjacent dynamic structures. The cover plate is movable relative to at least one of the two adjacent structures and provides a planar treadway which accommodates vertical loads, prevents dirt and debris from accumulating in the joint, and conceals the movement tolerance space for a finished appearance.

Stated more specifically, the sealing device of the present invention includes an elastomeric compression seal of essentially rectangular cross-sectional configuration and having outer vertical walls which engage mutually opposing vertical walls of the adjacent structural members. Since the cover plate will bear any vertical load imposed on the movement tolerant space, the vertical walls of the compression seal need exert only enough pressure on the adjacent structural members to maintain the seal in place, and need not exert force sufficient to withstand vertical loading. Accordingly, the seal walls can be thinner, reducing the cost of the seal. Further, since such a seal can be more easily compressed, installation of the seal into the movement tolerance space is facilitated.

The surface cover plate is a rigid, elongated member wide enough to span the movement tolerance space between the adjacent structural members. The cover plate rests on portions of the upper surfaces of the adjacent structural members contiguous to the movement tolerance space such that the cover plate is substantially coplanar with the upper surfaces of the structural members. In order not to impede normal expansion and contraction of the adjacent structural members, the cover plate is movable with respect to at least one of the structural members.

To prevent the cover plate from being lifted off the upper surface of the adjacent structures as the joint opens and closes, the compression seal is characterized by having a point thereon which remains a fixed distance from the plane defined by the upper surfaces of the adjacent structures as the joint opens and closes. Stated somewhat differently, the seal has a point thereon which is not displaced either upwardly or downwardly as the seal compresses and expands. The cover plate is attached to the compression seal at the point on the seal which remains a fixed distance from the plane defined by the upper surfaces of the adjacent structures, such that the cover plate is not displaced upwardly or downwardly by the compression or expansion of the seal.

The surface cover plate can be operatively associated with the compression seal in any one of a number of ways. First, the surface cover plate can be attached to the seal at a point on the upper wall of the seal intermediate of the outer vertical seal walls, such that the cover plate is movable with respect to both of the adjacent dynamic structures. In another embodiment, the cover plate is attached to the seal at the upper edge of one of the outer vertical seal walls, such that the cover plate is fixed with respect to the contiguous structural member and movable with respect to the opposite structural member. In yet another embodiment, a flange depending downwardly from the surface cover plate is interposed between one of the vertical seal walls and the vertical wall of the contiguous structural member, such that the compressive force exerted by the seal against the structural member clamps the flange to secure the cover plate in position.

In those embodiments where the surface cover plate is attached directly to the compression seal, a variety of methods for attachment are disclosed. In one embodiment, the seal and the cover plate are coextruded as a unitary structure. The unitary structural can advantageously be coextruded of two materials having dissimilar characteristics, such that the compression seal portion of the sealing device is elastomeric, while the cover plate portion of the sealing device is essentially rigid. In another embodiment, the cover plate and seal are formed as separate members and are vulcanized to form a unitary structure. In yet another embodiment, a flange formed on one of the compression seal or cover plate engages a corresponding channel in the other member, whereby the cover plate is snap-fitted to the seal. In another disclosed embodiment, the cover plate is adhesively bonded to the compression seal.

Thus, it is an object of the present invention to provide an improved sealing device for sealing the movement tolerance space between adjacent structural members such as concrete slabs in bridges, parking decks, and the like.

It is another object of the present invention to provide a sealing device which provides a weatherproof seal while providing improved accommodation of vertical loads.

It is yet another object of the present invention to provide an improved sealing device which affords a weatherproof seal while providing a planar upper surface for improved accommodation of pedestrian traffic.

It is another object of the present invention to provide an improved sealing device which affords a weatherproof seal yet is unaffected by ultraviolet radiation.

Another object of the present invention is to provide an improved sealing device which affords a weatherproof seal yet prevents dirt and debris from accumulating in the movement tolerance space and impeding the operation of the seal.

It is another object of the present invention to provide an improved sealing device which affords a weatherproof seal presenting an aesthetically pleasing appearance.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
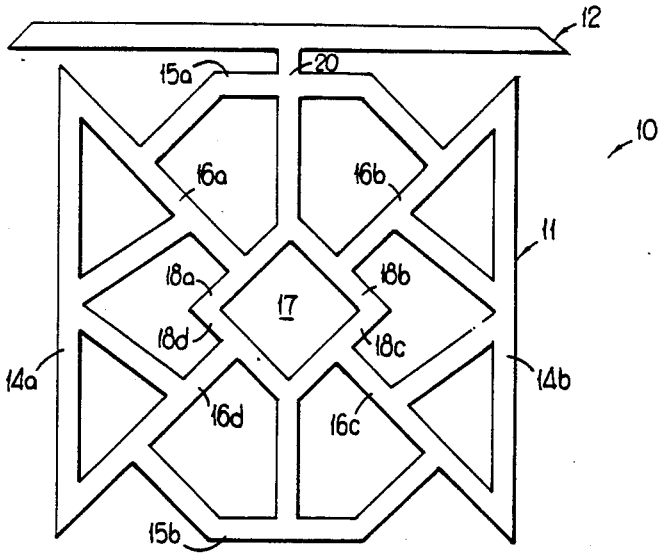
FIG. 1 shows an improved sealing device with compression seal and integral surface cover plate according to a first embodiment of the present invention.

Referring now to the drawing, in which like numerals indicate like elements throughout the several views, FIG. 1 shows a sealing device 10 comprising a compression seal 11 and an integral surface cover plate 12. The compression seal 11 includes opposing outer vertical walls 14*a*, 14*b* defining the sides of the compression seal 11, and upper and lower horizontal walls 15*a*, 15*b* defining the top and bottom of the compression seal 11. Lateral forces exerted against the vertical walls 14*a*, 14*b* are transmmitted through diagonal internal wall members 16*a*, 16*b*, 16*c*, 16*d* to a center square cell 17 defined by walls 18*a*, 18*b*, 18*c*, 18*d*.

As described in my U.S. Pat. No. 4,708,517, which patent is incorporated herein by reference, the seal 11 is characterized by an internal wall structure which collapses when the seal is compressed in such a manner that the seal is not significantly vertically elongated as it is compressed. Thus, the upper horizontal wall 15*a* is not significantly displaced either upwardly or downwardly as the seal 11 is compressed or expands. The seal described in my aforesaid patent provides the advantage of absorbing lateral compressive forces and redirecting those forces to support the upper and lower planar walls without vertically distorting the seal. In this manner, the upper seal wall is not vertically displaced as the seal expands or upper seal wall is not vertically displaced as the seal expands or depresses in a manner which could trip pedestrians. However, as will be seen, the provision of a seal 11 having an upper wall 15*a* which is displaced neither upwardly nor downwardly as the seal is compressed or expands provides additional advantages when used in the context of a combination seal and cover plate.

The surface cover plate 12 is a horizontal member attached to the upper wall 15*a* of the compression seal 11 at a point 20 intermediate of the vertical side walls 14*a*, 14*b* of the compression seal. The surface cover plate 12 is slightly wider than the compression seal 11 such that, when the sealing device 10 is installed as hereinbelow described, the cover plate completely conceals the top of the seal.

The sealing device 10 of the preferred embodiment is formed as a unitary extrusion of indeterminate length. The two components of the sealing device 10—the compression seal 11 and the surface cover plate 12—may be extruded from the same material, or may be coextruded from different materials, depending upon the desired characteristics of the two components. Compression seals known in the art are typically formed of neoprene. However, neoprene cannot be satisfactorily coextruded with a more rigid material, such as would be desirable for forming a surface cover plate. Accordingly, so that the sealing device 10 can be formed as a unitary extrusion, the compression seal must be formed from an elastomeric material which can be compatibly coextruded with a harder substance. Examples of a suitable elastomeric material for the compression seal 11 are the thermal plastics manufactured by Monsanto under the trademark "Santoprene" and by DuPont under the trademark "Alcryn". However, other materials which can be successfully coextruded may be substituted without departing from the scope and spirit of the appended claims.

In applications where the sealing device 10 is intended to support a vertical load, the surface cover plate 12 is preferably extruded from a rigid material. This can be accomplished by coextruding the cover plate from the same type of thermoplastic as the compression seal but having a different hardness, or by coextruding a different material such as neoprene or polyvinyl chloride. In the disclosed embodiment, the compression seal 11 is formed of a thermal plastic having a hardness of 60 to 80 on the Shore "A" scale, while the surface cover plate 12 is coextruded from a more rigid thermoplastic material having a hardness of 50 on the Shore "D" scale (approximately ten times harder than the compression seal).

For those applications where the surface cover plate is not required to support a vertical load but is needed only to provide an aesthetically pleasing appearance, such as in sealing a vertical movement tolerance space between adjacent wall members, the cover plate can be extruded from thermal plastic material having the same hardness as the compression seal 11.

Figure 2:
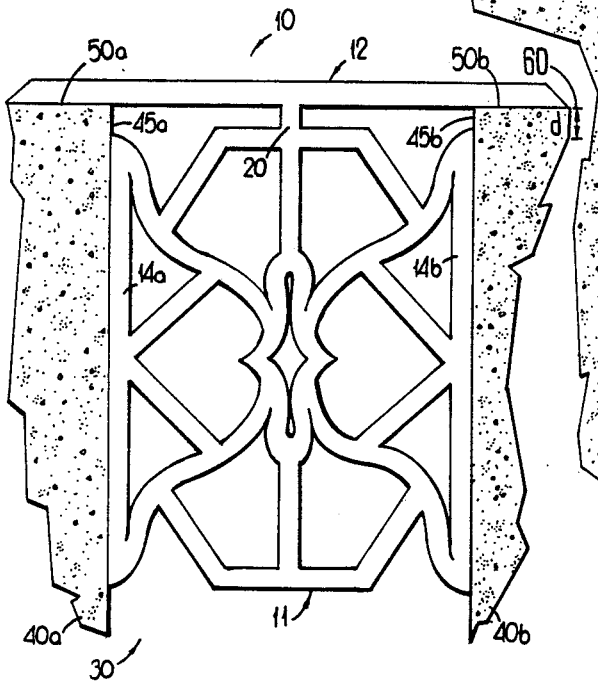
FIG. 2 shows the sealing device of FIG. 1 installed between adjacent structural members, with the compression seal expanded to 85% of its nominal width.

FIG. 2 shows the sealing device 10 installed in a movement tolerance space 30 between adjacent structural members 40*a*, 40*b* such as concrete slabs in bridges, parking decks, and the like. The structural members 40*a*, 40*b* have mutually facing wall portions 45*a*, 45*b* defining the boundaries of the movement tolerance space 30. In the manner well known to those skilled in the art, as the structural members 40*a*, 40*b* thermally contract, as shown in FIG. 2, the width of the movement tolerance space 30 increases; and as the adjacent structural members thermally expand, as shown in FIG. 3, the width of the movement tolerance space decreases.

In accordance with ASTM standards, the compression seal 11 of the sealing device 10 of the present invention is designed to operate over a range of from 85% of its nominal width to a point of maximum closure, defined as the point where the seal exerts a force of 35 PSI. While the compression seal 11 of the preferred embodiment reaches its point of maximum closure at 50% of nominal width, it will be appreciated that other cross-sectional designs operating over broader or narrower ranges of closure may be employed. In fact, one of the advantages of the present invention is that, since the compression seal need not support a vertical load, a low pressure seal affording a wider range of movement can be employed.

Figure 3:
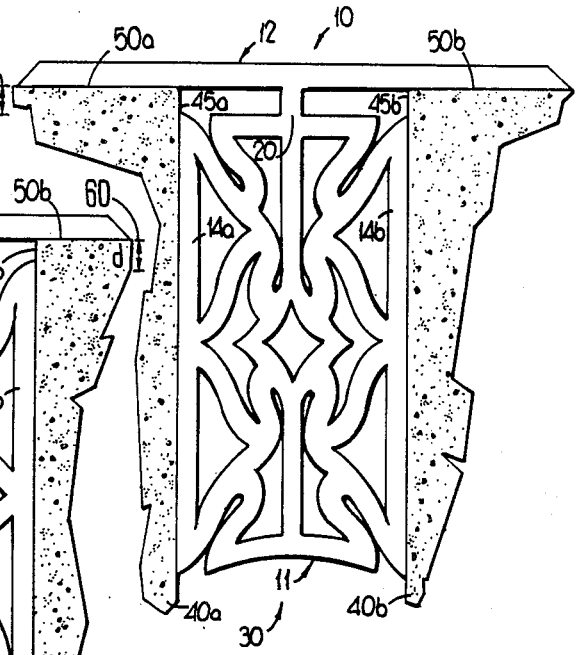
FIG. 3 shows the sealing device of FIG. 1 installed between adjacent structural members, with the compressed seal compressed to 50% of its nominal width.

With the sealing device 10 installed between adjacent structural members 40*a*, 40*b*, as shown in FIGS. 2 and 3, the compression seal 11 fits within the movement tolerance space 30 between the mutually facing wall portions 45*a*, 45*b* of the adjacent structural members. The surface cover plate 12 rests on portions of the upper surfaces 50*a*, 50*b* of the adjacent structural members contiguous to the movement tolerance space 30 such that the cover plate is substantially coplanar with the upper surfaces of the structural members. The cover plate 12 is wide enough to span the movement tolerance space 30 even when the adjacent structural members are at their point of maximum thermal contraction, as shown in FIG. 2. In this manner, the surface cover plate covers the movement tolerance space to prevent dirt and debris from entering the movement tolerance space and to provide an aesthetically pleasing appearance.

The vertical walls 14*a*, 14*b* of the compression seal 11 resile outwardly to press against the mutually facing vertical walls 45*a*, 45*b* of the adjacent structural members. In this manner, the compression seal 11 effectively seals the movement tolerance space to form an airtight and watertight barrier. As the adjacent structural members expand, as shown in FIG. 3, the compression seal 11 collapses in a controlled manner to maintain the vertical walls 14*a*, 14*b* in intimate contact with the mutually facing vertical walls 45*a*, 4*b* of the adjacent structural members 40*a*, 40*b*.

With the surface cover plate 12 attached to the compression seal 11 at a point 20 intermediate the vertical walls 14*a*, 14*b* of the compression seal, the surface cover plate moves with respect to both structural members as the structural members expand and contract. Further, the cover plate 12 is attached to the upper horizontal wall 15*a* of the compression seal 11 at a point 20 thereon which remains a constant distance d from the plane 60 defined by the upper surfaces 50*a*, 50*b* of the adjacent structural members 40*a*, 40*b* as the joint opens and closes. Thus, the cover plate 12 is not vertically displaced, either upwardly or downwardly, as the seal 11 is compressed or expands. The cover plate is thus maintained in firm contact with the upper surfaces 50*a*, 50*b* of the adjacent structural members 40*a*, 40*b* at all times.

While the sealing device 10 of the preferred embodiment is disclosed with respect to a unitary extrusion, it will be appreciated by those skilled in the art that the compression seal 11 and surface cover plate 12 of the sealing device can be formed as separate elements and vulcanized to form a unitary structure. In such an embodiment, the compression seal 11 and surface cover plate 12 would be formed as distinct elements separated generally at the point 20 in FIG. 1. Later, in the field if desired, and even after the compression seal 11 has been installed within the movement tolerance space 30, the two elements can be joined by heating one or both at the point of juncture 20 with a conventional vulcanizing iron known in the art. The resulting vulcanzed unitary structure will function in the same manner as if formed as a unitary extrusion.

Figure 4:
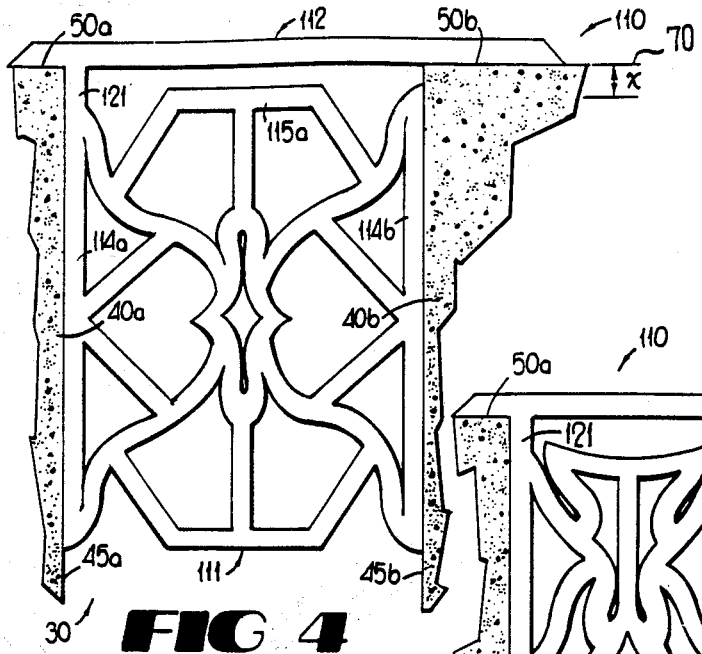
FIG. 4 shows a first alternate embodiment of a sealing device with compression seal and integral surface cover plate according to the present invention, installed between adjacent structural members, with the compression seal expanded to 85% of its nominal width.
Figure 5:
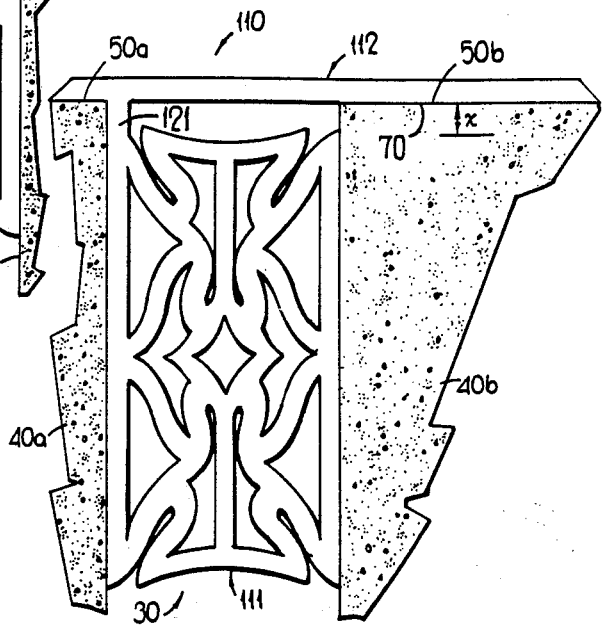
FIG. 5 shows the sealing device of FIG. 4 with the compression seal compressed to 50% of its nominal width.

Referring now to FIG. 4, a first alternate embodiment of a sealing device 110 is installed in the movement tolerance space 30 between adjacent structural members 40*a*, 40*b* having mutually facing vertical wall portions 45*a*, 45*b*. The sealing device 110 comprises a compressison seal 111 and a surface cover plate 112 formed as a unitary structure. In the same manner as hereinabove described for the sealing device 10, the compression seal 111 and surface cover plate 112 can be coextruded from the same material having the same hardness, from the same material having different hardnesses, or from different materials having different hardnesses. The compression seal 111 has outer vertical walls 114*a*, 114*b* and an upper wall 115. However, rather than the cover plate 112 being attached to the compression seal 111 at a point on the upper surface of the seal intermediate of the outer vertical walls 114*a*, 14*b*, the surface cover plate 112 of the sealing device 110 is attached to the compression seal 111 at the upper edge 121 of one of the outer vertical seal walls 114*a*. Since the vertical seal wall 114*a* is pressed firmly against the vertical wall section 45*a* and is thus fixed with respect to the contiguous structural member 40*a*, the surface cover plate 112 is fixed with respect to the contiguous structural member 40*a* and is movable with respect to the opposite structural member 40*b*. Thus, as shown in FIG. 5, when the structural members 40*a*, 40*b* are in a state of maximum thermal expansion, such that the movement tolerance space 30 therebetween is at its narrowest width, the surface cover plate 112 slides relative to the upper surface 50*b* of the structural member 40*b*, but is fixed with respect to the upper surface 50*a* of the structural member 40*a*.

Further, since the vertical seal wall 114*a* is fixed with respect to its contiguous structural member 40*a*, the upper edge 121 of the vertical seal wall 114*a* is fixed with respect to the structural member 40*a* and therefore with respect to the upper surface 50*a* of the structural member 40*a* and to the plane 70 defined thereby. The point of attachment 121 of the cover plate to the seal is separated from the plane 70 by a distance x, as shown in FIGS. 4 and 5. Since the point 121 is fixed with respect to the plane 70 defined by the upper surface 50*a* of the structural member 40*a*, the distance x remains constant whether the joint is opened, as in FIG. 4, or closed as depicted in FIG. 5. This fixed relationship between the point of attachment 121 and the plane 70 provides the advantage that the cover plate remains firmly disposed against the upper surfaces 50*a*, 50*b* of the adjacent structural members 40*a*, 40*b* as the joint opens and closes, rather than being lifted away from the upper surfaces, as would occur if the attachment point were vertically displaced as the seal compresses or expands.

Figure 6:
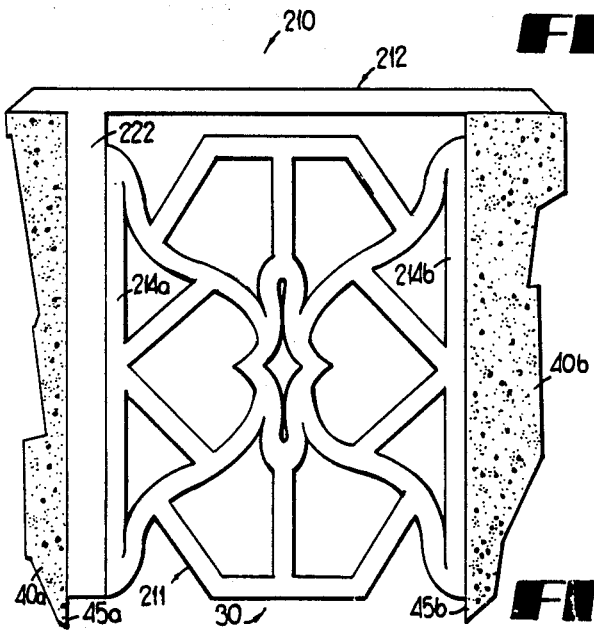
FIG. 6 shows a second alternate embodiment of a sealing device according to the present invention.

A second alternate embodiment of a sealing device 210 is illustrated in FIG. 6. In the sealing device 210, the compression seal 211 and the surface cover plate 212 are formed as a separate components. The compression seal 211 is again formed as an elastomeric extrusion of indeterminate length and having outer vertical walls 214*a*, 214*b* defining the outer vertical boundaries of the compression seal 211.

The surface cover plate 212 has a flange 222 depending downwardly therefrom and adjacent to a lateral edge thereof. Since the surface cover plate 212 is not coextruded with the compression seal 211 but rather is formed as a separate component, the choice of materials for the compression seal 211 and the surface cover plate 212 is not limited to materials which can be compatibly coextruded. Accordingly, the compression seal 211 can be formed from neoprene, thermal plastic, or other appropriate elastomeric material. Similarly, the surface cover plate 212 can be formed from plastic, rubber, metal, wood, or other appropriate material, or a combination of such materials, rather than being limited to a material which can be compatibly coextruded with the compression seal.

To install the sealing device 210 in the movement tolerance space 30 between adjacent structural members 40*a*, 40*b*, the surface cover plate 212 is installed with the lower edge of the plate resting on the upper surfaces of the adjacent structural members, and the downwardly depending flange intimately contacting the vertical wall portion 45*a* of the structural member 40*a*. The compression seal is installed within the movement tolerance space 30 so that one vertical wall 214*a* of the compression seal bears against the downwardly depending flange 222 of the surface cover plate 212, and the other vertical wall 214*b* bears against the vertical wall portion 45*b* of the opposite structural member 40*b*. With the sealing device 210 installed in this manner, the flange 222 of the surface cover plate 212 is clamped between the vertical wall portion 45*a* of the contiguous structural member 40*a* by the outward resiliency of the compression seal 211. In this manner, the surface cover plate 212 is fixed with respect to the structural member 40*a* and is movable with respect to the structural member 40*b* as the structural members thermally expand and contact.

While the surface cover plate 212 with downwardly depending flange 222 is disclosed with respect to a unitary structure, it will be understood that it is within the contemplation of the present invention to construct the cover plate and flange as two components and fasten them together, either before or during installation, in an appropriate manner.

Figure 7:
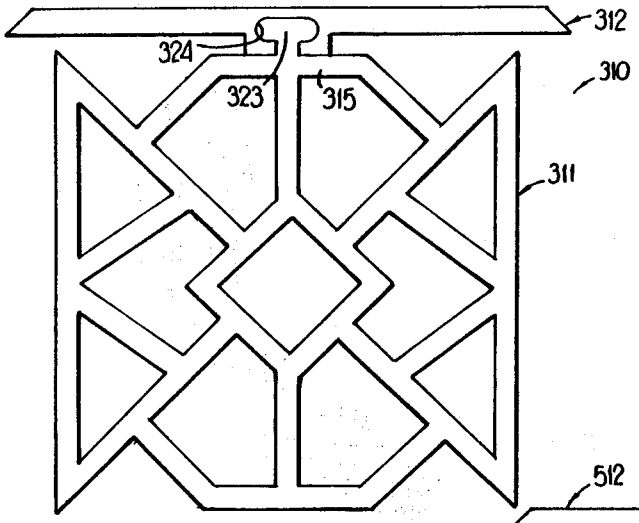
FIG. 7 shows a third alternate embodiment of a sealing device according to the present invention.

FIG. 7 shows a third alternate embodiment of a sealing device 310 including a compression seal 311 and surface cover plate 312. In this embodiment, the compression sesal 311 and surface cover plate 312 are formed as separate components which are mechanically locked together. The upper wall 315 of the compression seal 311 has a tab 323 formed thereon which snap-fittingly engages a corresponding channel 324 formed on the lower surface of the cover plate 312.

Figure 8:
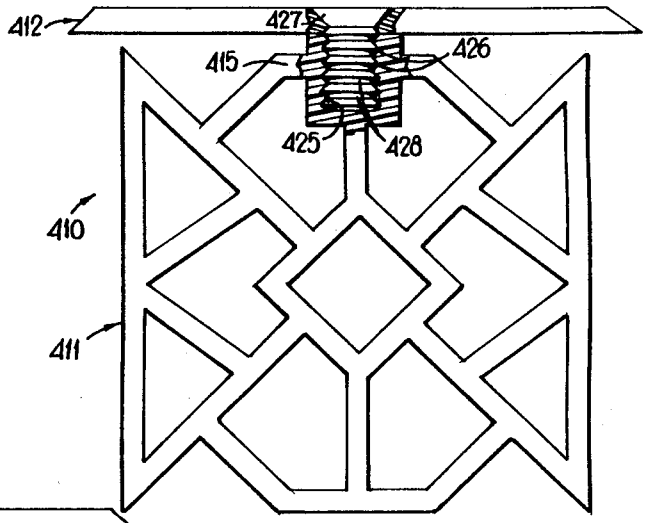
FIG. 8 shows a fourth alternate embodiment of a sealing device according to the present invention.

In a similar manner, FIG. 8 shows a fourth alternate embodiment of a sealing device 410 including a compression seal 411 and surface cover plate 412 formed as separate components which are mechanically locked together. In this embodiment, the compression seal 411 has a channel 425 formed in its upper wall 415. The mutually facing interior vertical walls of the channel have a plurality of longitudinal grooves 426 formed thereon. Screws 427, inserted through the surface cover plate 412 at longitudinally spaced intervals, have threaded shanks 428 which engage the longitudinal grooves 426 on opposing sides of the channel 425 to fasten the surface cover plate to the compression seal 411.

Figure 9:
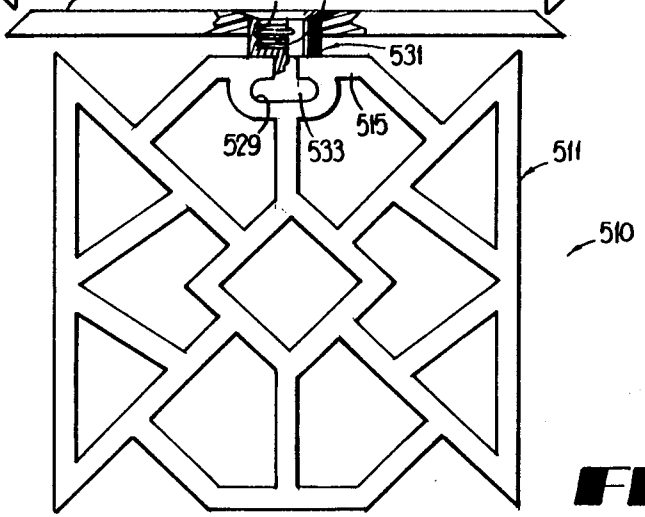
FIG. 9 shows a fifth alternate embodiment of a sealing device according to the present invention.

FIG. 9 illustrates yet another alternate embodiment of a sealing device 510 having a compression seal 511 and separately formed surface cover plate 512 fastened together by mechanical means. The compression seal 511 has a channel 529 formed in its upper wall 515. A collar 531 has a threaded bore 532 formed in its upper end and a tab 533 formed on its lower end for snap-fittingly engaging the channel 529 formed in the upper wall 515 of the compression seal 511. A screw 527 inserted through the cover plate 512 engages the threaded bore 532 of the collar 531 to fasten the cover plate 512 to the compression seal 511.

It will be appreciated tha the sealing devices 310, 410, and 510, once assembled, are similar to the sealing device 10 of the preferred embodiment, in that the surface cover plate is attached to the upper surface of the compression seal at a point intermediate of the outer vertical seal walls. Accordingly, the operation of the sealing devices 310, 410, and 510, once assembled and installed, is similar to the operation of the sealing device 10 as hereinabove described. In particular, it will be noted that, by mechanically attaching the surface, cover plate to an intermediate point on the upper seal surface, the surface cover plate moves wth respect to both adjacent dynamic structures 40*a*, 40*b* as the structures expand and contract.

However, in the same sense that the alternate embodiments of the sealing devices 310, 410, and 510 have their surface cover plates mounted to an intermediate point on the upper seal surface, so as to function in a manner similar to the sealing device 10, it is within the contemplation of this invention that a surface cover plate can be formed as a separate member and attached to a point atop one of the outer vertical seal walls, in a manner similar to the sealing device 110. With the surface cover plate thus fixed with respect to one of the outer vertical seal walls, the cover plate would be fixed with respect to one of the adjacent dynamic structural members and movable with respect to the opposite structural member as the members expand and contract, in the same manner as hereinabove described for the sealing device 110.

While the compression seals 11, 111, 211, 311, 411, and 511 have been disclosed with respect to seals having diagonal walls which transmit lateral forces applied against the vertical side walls to a center square cell, it will be understood that this particular cross-sectional configuration is disclosed by way of example only, and that other compression seal designs may be adapted for use in the sealing device of the present invention without departing from the scope and spirit of the appended claims.

An important feature of the present invention is that the surface cover plate, rather than the compression seal, bears the weight of any vertical load exerted against the joint between the adjacent structuraal members. One advantage of this feature is that, since the compression seal does not have to be capable of supporting a vertical load, the compression seal need exert only enough force against the walls of the movement tolerance space to provide an airtight and watertight seal and maintain the compression seal in place. Accordingly, the seal can be constructed using thinner interior walls, resulting in reduced production costs and permitting easier installation.

Another important feature of the present invention is the use of a surface cover plate to cover the compression seal. One advantage of this feature is that the cover plate will prevent dirt and debris from entering the movement tolerance space and accumulating in depressions and indentations in the upper surface of the seal. Thus, the problem of dirt and debris accelerating wear on the seal or impeding the normal movement of the seal is eliminated.

Another advantage of using a surface cover plate to protect a compression seal is the shielding of the compression seal from ultraviolet rays in sunlit areas. Since ultraviolet rays accelerate the aging of the elastomer in the compression seal, and since the compression seal is dependent upon its elasticity in order to maintain an effective seal between the adjacent structural members, the use of a surface cover plate to shield the compression seal can postpone the aging of the elastomer and prevent premature seal failure.

Yet another advantage of using a surface cover plate in conjunction with the compression seal is that the compression seal need not be designed to collalpse in such a manner as to present substantially planar upper surface. When a compression seal is used alone, the seal must collapse in such a manner as not to protrude upwardly of the pavement surface, where it can present an obstruction over which pedestrians might trip, or where it can become dislodged by snowplows or the like. Conversely, however, if the seal is designed to collapse downwardly in response to lateral forces, women's high heels can easily become lodged in the depression. With the sealing device of the present invention, however, it is the planar surface cover plate, not the upper surface of the compression seal, which is the exposed surface. Thus, it is not nearly so critical how the compression seal collapses in response to lateral forces, since the cover plate will always provide a planar upper surface.

Another advantage to using a surface cover plate in conjunction with a compression seal is that an airtight and watertight joint between adjacent structural members can be provided while presenting an aesthetically pleasing appearance. The cover plate provides a more aesthetically pleasing appearance than the crevices and depressions presented by the upper surface of a compression seal. However, the surface cover plate is incapable of providing an airtight and watertight seal. Thus, by using the two in conjunction, an airtight and watertight seal can be provided without sacrificing aesthetic apperance.

Furthermore, while the form of a conventional compression seal is dictated by its function, use of a compression seal in conjunction with a cover plate affords flexibility in the possible configuration of the cover plate without sacrificing the sealing capability of the device. For example, while a flat or planar cover plate such as disclosed hereinabove would be suitable for pedestrian areas, a convex cover plate might be used for roof applications to channel water. Alternatively, a concave cover plate configuration would provide a conduit defined by the compression seal, vertical walls of the structural members, and cover plate, which might advantageously be incorporated into a drainage system. A multi-planar for undulating cover plate configuration might afford an aesthetically pleasing appearance, while a corrugated or serrated cover plate could be used to provide a non-skid surface. An angled cover plate could be used in applications where a smooth transition between two uneven planes is desired, or where dictated by drainage considerations. And finally, the cover plate can be formed with appropriate recesses or grooves for attaching decorative color strips, carpet inserts to match existing carpet, or skid-resistant insert strips suitable for pedestrian walkways.

It will be understood that the terms "upper", "lower", "horizontal", "vertical" and the like are used herein for convenience of description, and are not intended to limit the sealing device to any particular physical orientation.

Finally, it will be understood that the preferred embodiment of the present invention has been disclosed by way of example, and that other modifications may occur to those skilled in the art without departing from the scope and spirit of the appended claims.

What is claimed is:

1. A sealing device for sealing a movement tolerance space between adjacent dynamic structures having substantially coplanar upper surfaces and mutually facing vertical walls, said sealing device comprising:

a multitubular elastomeric seal having an upper wall and having outer side walls operatively associated with said upper wall and comprising the sides of said seal which contact said mutually facing walls of said adjacent dynamic structures when said seal is interposed therebetween, said seal being collapsible in response to lateral compressive forces created by the thermal expansion of said adjacent dynamic structures, said seal further resiling upon lateral contraction of said adjacent dynamic structures to maintain constant intimate contact between said outer side walls of said seal and said mutually facing vertical walls of said adjacent dynamic structures, whereby said movement tolerance space is sealed, and said upper wall of said seal further having a point thereon intermediate said outer side wall which remains a fixed distance from the plane defined by said substantially coplanar upper surfaces of said adjacent dynamic structures as said seal collapses and resiles; and a substantially rigid cover plate attached to said upper wall of said seal at said point thereon intermediate said outer side walls which remains said fixed distance from said plane defined by said substantially coplanar upper surfaces of said adjacent dynamic structures for covering said movement tolerance space, said cover plate lying substantially in said plane defined by said upper surfaces of said adjacent dynamic structures when said seal is installed within said movement tolerance space, said cover plate being moveable relative to at least one of said adjacent dynamic structures.

2. The sealing device of claim 1, wherein said cover plate is attached to said seal at a point on said upper wall intermediate said outer side walls such that said cover plate is movable with respect to both said adjacent dynamic structures.

3. The sealing device of claim 1, wherein said seal and said cover plate are coextruded as a unitary structure.

4. The sealing device of claim 1, wherein said cover plate and said seal are formed as separate members and vulcanized to form a unitary structure.

5. The sealing device of claim 1, wherein said cover plate is snap-fitted to said upper wall of said seal.

6. The sealing device of claim 1, further comprising means for fastening said cover plate to said upper wall of said seal.

7. The sealing device of claim 6, wherein said fastening means comprises an adhesive bonding means.

8. The sealing device of claim 6, wherein said fastening means comprises mechanical locking means.

9. The sealing device of claim 8, wherein said mechanical locking means comprises a tab on one of said cover plate or upper seal wall and a corresponding slot on the other of said cover plate or upper seal wall, whereby said tab is lockably received within said slot to mechanically lock said cover plate to said seal.

10. A sealing device for sealing a movement tolerance space between adjacent dynamic structures having substantially coplanar upper surfaces and mutually facing vertical walls, said sealing device comprising:

a multitubular elastomeric seal having an upper wall and having outer side walls comprising the sides of said seal which contact said mutually facing walls of said adjacent dynamic structure when said seal is interposed therebetween, said seal being collapsible in response to lateral compressive forces created by the thermal expansion of said adjacent dynamic structures, and said seal further resiling upon lateral contraction of said adjacent dynamic structures to maintain constant intimate contact between said outer side walls of said seal and said mutually facing vertical walls of said adjacent dynamic structures, whereby said movement tolerance space is sealed; and a substantially rigid cover plate for covering said movement tolerance space, said cover plate including a flange depending downwardly therefrom such that when said cover plate is disposed substantially in the plane defined by the upper surfaces of said adjacent dynamic structures, said flange is received between one of said outer side seal walls and the vertical wall of the corresponding dynamic member when said seal is installed within said movement tolerance space such that the compressive force between said seal and said dynamic member clamps said flange to secure said cover plate in position, whereby said cover plate is stationary relative to said corresponding dynamic member and is movable with respect to the other of said dynamic members.

* * * * *